US005339138A

United States Patent [19]

Mishima et al.

[11] Patent Number: 5,339,138

[45] Date of Patent: Aug. 16, 1994

[54] ELECTROPHOTOGRAPHIC IMAGE FORMATION METHOD

[75] Inventors: Naoshi Mishima; Toshio Fukagai; Kiyoshi Taniguchi; Hiroyuki Kishi; Tomohiro Inoue, all of Numazu; Yoshiaki Kawasaki, Shizuoka, all of Japan

[73] Assignee: Ricoh Company, Ltd., Tokyo, Japan

[21] Appl. No.: 111,513

[22] Filed: Aug. 24, 1993

[30] Foreign Application Priority Data

Aug. 26, 1992 [JP] Japan ..... 4-250706

[51] Int. Cl.[5] ..... G03G 21/00

[52] U.S. Cl. ..... 355/296; 118/652; 355/215; 355/30; 430/125

[58] Field of Search ..... 355/30, 215, 296, 219, 355/221; 118/652; 430/125

[56] References Cited

U.S. PATENT DOCUMENTS 4,401,385 8/1983 Katayama et al. ..... 118/652 X
5,155,531 10/1992 Kurotori et al. ..... 355/215
5,164,778 11/1992 Tanabe et al. ..... 355/215
5,185,629 2/1993 Iino et al. ..... 355/215
5,250,990 10/1993 Fujimura et al. ..... 355/299 X
5,264,903 11/1993 Nagame et al. ..... 355/297

*Primary Examiner*—Matthew S. Smith
*Attorney, Agent, or Firm*—Oblon, Spivak, McClelland, Maier & Neustadt

[57] ABSTRACT

An electrophotographic image formation method using an electrophotographic photoconductor composed of an electroconductive support, and a photoconductive layer including a charge generation layer and a charge transport layer which are successively overlaid on the support, having the steps of charging the surface of the electrophotographic photoconductor uniformly to a predetermined polarity, exposing the charged surface of the photoconductor to light images to form electrostatic latent images thereon, developing the electrostatic latent images to visible toner images by a developer, transferring the toner images to an image-receiving medium, and cleaning the surface of the photoconductor, with the concentration of ozone in the ambient atmosphere around the photoconductor being controlled in the range from 5 to 50 ppm, and the abrasion of the photoconductive layer being controlled to 300 Å or less per 1000 revolutions of the photoconductor.

1 Claim, 2 Drawing Sheets

ELECTROPHOTOGRAPHIC IMAGE FORMATION METHOD

BACKGROUND OF THE INVENTION

1. Field of the Invention

The present invention relates to an electrophotographic image formation method based on the Carlson process to obtain visible toner images on an image-receiving medium using a function-separating laminated-type electrophotographic photoconductor comprising an electroconductive support, and a photoconductive layer comprising a charge generation layer and a charge transport layer which are successively formed on the support.

2. Discussion of Background

According to the Carlson process, the surface of an electrophotographic photoconductor is uniformly charged to a predetermined polarity and the charged surface is exposed to light images to form electrostatic latent images thereon, and then the electrostatic images thus formed are developed to visible toner images by a developer. In addition to the above, the toner images are transferred to an image-receiving medium such as a sheet of paper and fixed thereon.

In the electrophotographic photoconductor, inorganic photoconductive materials such as selenium, cadmium sulfide and zinc oxide are conventionally used. Recently, photoconductors comprising organic photoconductive materials such as poly-N-vinylcarbazole and polyvinyl anthracene have been studied and developed.

The electrophotographic photoconductors employing organic photoconductive materials are divided into two groups. One is a single-layered photoconductor comprising an electroconductive support and a photoconductive layer formed on the support, in which a charge generating material and a charge transporting material are dispersed in a binder resin; and the other is a function-separating laminated-type photoconductor comprising an electroconductive support, and a charge generation layer and a charge transport layer which are successively overlaid on the support. The charge generation layer and the charge transport layer respectively comprise a charge generating material and a charge transporting material, each of which is dispersed in a binder resin in the layer. The characteristics of the organic photoconductive materials are drastically improved when they are used in the above-mentioned function-separating laminated-type photoconductor because appropriate materials constituting the charge generation layer and the charge transport layer can be individually selected.

However, the laminated-type electrophotographic photoconductor has the shortcoming that, for instance, when the charge transport layer is formed on the charge generation layer, the charge transport layer is easily worn when coming in contact with various members such as a developer at a development step, an image-receiving medium at an image-transfer step, and a cleaning member at a cleaning step because the charge transport layer comprises organic materials. Due to the wear of the charge transport layer, the photosensitivity of the photoconductor is decreased, with the result that abnormal images such as toner deposition on the background are induced.

To improve the wear-resistance and the durability of the charge transport layer, the following photoconductors are proposed:

(1) a photoconductor comprising a charge transport layer with a thickness of 25 μm or more, as disclosed in Japanese Laid-Open Patent Application 1-267551;

(2) a photoconductor comprising a protective layer formed on a charge transport layer, which comprises a binder resin comprising as the main component polyurethane, as disclosed in Japanese Laid-Open Patent Application 58-122553;

(3) a photoconductor comprising a protective layer formed on a charge transport layer, which comprises a hardening silicone resin, as disclosed in Japanese Laid-Open Patent Application 61-51155;

(4) a photoconductor comprising a protective layer formed on a charge transport layer, which comprises as the main component polyetherimide, as disclosed in Japanese Laid-Open Patent Application 2-161449;

(5) a photoconductor comprising multiple charge transport layers, with the concentration of a charge transporting material in each charge transport layer being decreased toward the surface of the photoconductor, as disclosed in Japanese Laid-Open Patent Application 2-160247; and (6) a photoconductor comprising a surface layer formed on a charge transport layer, which comprises finely-divided, spherical particles of a resin such as a silicone resin, as disclosed in Japanese Laid-Open Patent Application 63-2072.

However, the above-mentioned photoconductors have their own drawbacks. For instance, the deterioration in photosensitivity of the photoconductor (1) due to the wear of the charge transport layer can be reduced to some extent, but the photosensitivity is not sufficient for use in practice. In addition, the deterioration performance of a coating liquid for the charge transport layer of this type is poor in the coating operation, so that the obtained charge transport layer becomes uneven. Therefore, it is necessary to improve the facilities for producing such a photoconductor, which leads to the rise of manufacturing cost.

The photoconductor (2) has the drawback that image blurring occurs under the atmosphere of high humidity because the surface resistivity of the photoconductor is decreased.

The residual potential of the photoconductor (3) is apt to increase, with the result that the toner deposition on the background occurs at a relatively early stage during a repeated copying operation.

The drawback of the photoconductor (4) is that the photosensitivity considerably deteriorates and the residual potential readily increases, which causes the toner deposition on the background.

In the photoconductor (5), since a lower charge transport layer is dissolved in a coating liquid for an upper charge transport layer while it is applied to the lower charge transport layer, the charge transporting material in the lower charge transport layer transfers to the upper charge transport layer. In fact, the ratio of the charge transporting material to the binder resin in the upper charge transport layer is increased as compared with that in the lower charge transport layer, so that it is difficult to improve the wear resistance of the charge transport layer.

Furthermore, to prevent the decrease of the photosensitivity of the photoconductor, several methods are known, for example, a method of controlling the exposure of a photoconductor in accordance with the detection of the total number of revolutions of the photoconductor and the total charging time thereof, as disclosed in Japanese Laid-Open Patent Application 4-26871; and a method of scraping a portion caused to deteriorate by ozone from a photoconductor while in use, as disclosed in Japanese Laid-Open Patent Application 1-133086.

However, the former method has the shortcoming that the process itself is so complex that an apparatus for executing this process becomes complicated. By the latter method, the deterioration in photosensitivity cannot be sufficiently prevented.

SUMMARY OF THE INVENTION

Accordingly, an object of the present invention is to provide an electrophotographic image formation method capable of producing excellent images without any defects such as toner deposition on the background, and capable of preventing any decrease in the photosensitivity of a photoconductor which may be caused by the wear of the surface thereof during repeated operations over a long period of time.

The above-mentioned object of the present invention can be achieved by an electrophotographic image formation method using an electrophotographic photoconductor comprising an electroconductive support, and a photoconductive layer comprising a charge generation layer and a charge transport layer which are successively overlaid on the support, comprising the steps of charging the surface of the electrophotographic photoconductor uniformly to a predetermined polarity, exposing the charged surface of the photoconductor to light images to form electrostatic latent images thereon, developing the electrostatic latent images to visible toner images by a developer, transferring the toner images to an image-receiving medium, and cleaning the surface of the photoconductor, with the concentration of ozone in the ambient atmosphere around the photoconductor being controlled in the range from 5 to 50 ppm, and the abrasion of the photoconductive layer being controlled to 300 Å or less per 1000 revolutions of the photoconductor.

BRIEF DESCRIPTION OF THE DRAWINGS

A more complete appreciation of the present invention and many of the attendant advantages thereof will be readily obtained as the same becomes better understood by reference to the following detailed description when considered in connection with the accompanying drawings, wherein.

DETAILED DESCRIPTION OF THE PREFERRED EMBODIMENTS

The inventors of the present invention have discovered that in an electrophotographic photoconductor which comprises an electroconductive support, and a photoconductive layer comprising a charge generation layer and a charge transport layer which are successively formed on the support in this order, the deterioration in the photosensitivity which may be caused by the wear of the surface of the photoconductor during repeated copying operations can be reduced by controlling the concentration of ozone in the ambient atmosphere around the photoconductor. It is considered that this is because the ozone which is generated in the course of the copying operations permeates through the charge transport layer of the photoconductor, reaches the charge generation layer, and improves the charge generating efficiency of a charge generating material contained in the charge generation layer, thereby increasing the photosensitivity to such a degree as to compensate for the deterioration of photosensitivity caused by the wear of the charge transport layer.

Figure 1:
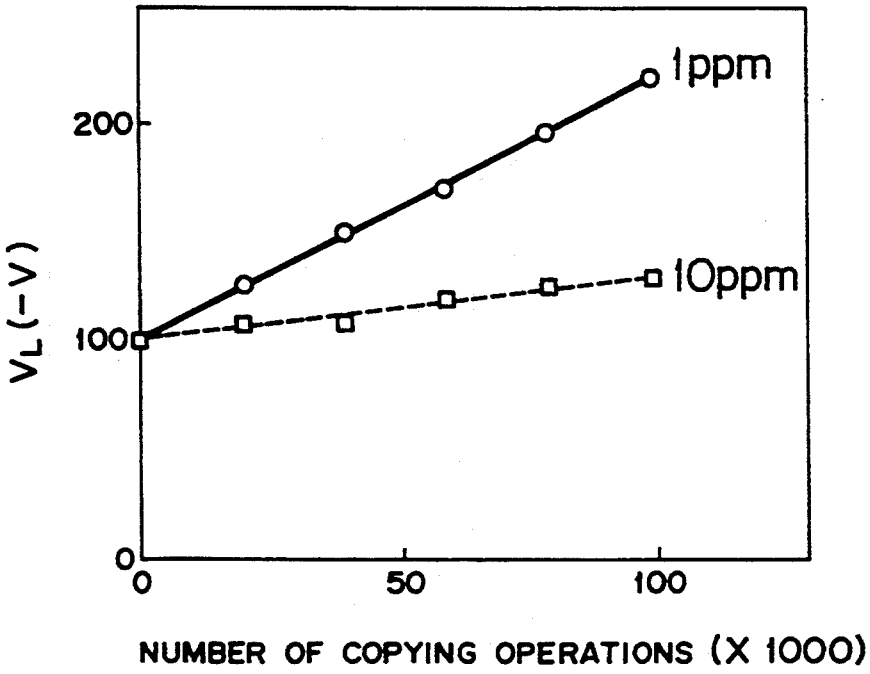
FIG. 1 is a graph which shows the relationship between the changes in the surface potential $\Delta V_L$ (V) of a light portion of a photoconductor and the number of repeated copying operations, with the ozone concentration around the photoconductor being set at 1 ppm and at 10 ppm.

FIG. 1 is a graph showing the relationship between the changes in the surface potential ($V_L$) of a light portion of the photoconductor and the number of repeated copying operations, with the ozone concentration in the ambient atmosphere around the photoconductor being set at 1 ppm and at 10 ppm. As is apparent from the graph shown in FIG. 1, the changes in the surface potential ($V_L$) of a light portion of the photoconductor are smaller at the ozone concentration of 10 ppm than those at the ozone concentration of 1 ppm. Furthermore, the inventors have discovered that when an electrophotographic image formation is carried out under the conditions that the ozone concentration in the ambient atmosphere around the photoconductor is set at 5 ppm or more, and the abrasion of the photoconductor is adjusted to 300 Å or less per 1,000 revolutions of the photoconductor, the deterioration in the photosensitivity of the photoconductor can be remarkably decreased. When the ozone concentration around the photoconductor exceeds 50 ppm in the course of image formation, the charging potential is conspicuously decreased. Therefore, it is effective to control the ozone concentration around the photoconductor within the range from 5 to 50 ppm in the course of image formation.

The adjustment of the ozone concentration within the above-mentioned range in the course of image formation can be carried out by an electrophotographic copying apparatus using the Carlson process, equipped with a rotation-speed-variable exhaust fan.

In the electrophotographic image formation method of the present invention, the abrasion of the photoconductor can be reduced to 300 Å or less per 1,000 revolutions of the photoconductor by selecting an appropriate binder resin for use in the photoconductive layer, for example, the charge transport layer, or by adjusting the contact pressure applied to the photoconductor in the process of development, image-transfer and cleaning.

The electrophotographic photoconductor for use with the image formation method of the present invention comprises an electroconductive support, and a charge generation layer and a charge transport layer which are successively formed on the support.

An electroconductive material with a volume resistivity of $10^{10}$ Ω.cm or less can be used for the support of the electrophotographic photoconductor. Examples of such an electroconductive material include metals such as aluminum, titanium, nickel, chromium, nichrome, Hastelloy, palladium, magnesium, zinc, copper, gold and platinum and alloys thereof, and metallic oxides such as tin oxide, indium oxide and antimony oxide. These metals and metallic oxides may be deposited or sputtered on a sheet of a plastic material or paper in the form of a film or cylinder. Alternatively, the aforementioned metals or metallic oxides may be dispersed in a binder resin and the mixture thus obtained may be coated on a sheet of the plastic material or paper. In addition, a plastic sheet in the form of a film or cylinder in which the above-mentioned metals, metallic oxides, or electroconductive carbon is dispersed can be used as the support of the photoconductor. Furthermore, as the electroconductive support, a plate, a belt and a base drum made of aluminum, aluminum alloy, iron, nickel alloy, stainless steel alloy or titanium alloy can be used. In particular, the base drum can be made by producing a tube by drawing and ironing (D.I.), impact ironing (I.I.), extrusion or pultrusion, followed by surface-treatment such as cutting, superfinishing and grinding.

The charge generation layer comprises a binder resin and a charge generating material which is dispersed or dissolved in the binder resin.

As the charge generating material for use in the present invention, C.I. Pigment Blue 25 (C.I. No. 21180), C.I. Pigment Red 41 (C.I. No. 21100), C.I. Acid Red 52 (C.I. No. 45100), C.I. Basic Red 3 (C.I. No. 45210), a phthalocyanine pigment having a porphyrin skeleton, an azulenium salt pigment, a squaric salt pigment, an anthoanthanthrone pigment, an azo pigment having a carbazole skeleton (Japanese Laid-Open Patent Application 53-95033), an azo pigment having a stilbene skeleton (Japanese Laid-Open Patent Application 53-138229), an azo pigment having a triphenylamine skeleton (Japanese Laid-Open Patent Application 53-132547), an azo pigment having a dibenzothiophene skeleton (Japanese Laid-Open Patent Application 54-21728), an azo pigment having an oxadiazole skeleton (Japanese Laid-Open Patent Application 54-12742), an azo pigment having a fluorenone skeleton (Japanese Laid-Open Patent Application 54-22834), an azo pigment having a bisstilbene skeleton (Japanese Laid-Open Patent Application 54-17733), an azo pigment having a distyryl oxadiazole skeleton (Japanese Laid-Open Patent Application 54-2129), a trisazo pigment having a distyryl carbazole skeleton (Japanese Laid-Open Patent Application 54-17734), a trisazo pigment having a carbazole skeleton (Japanese Laid-Open Patent Application 57-195767), indigo pigments such as C.I. Vat Brown 5 (C.I. No. 73410) and C.I. Vat Dye (C.I. No. 73030), and perylene pigments such as Algol Scarlet B and Indanthrene Scarlet R (made by Bayer Co., Ltd.) can be employed.

Specific examples of the binder resin for use in the charge generation layer include thermoplastic resins and thermosetting resins such as polystyrene, styrene-butadiene copolymer, styrene-acrylonitrile copolymer, styrene-maleic anhydride copolymer, polyester, polyarylate, polyvinyl chloride, vinyl chloride-vinyl acetate copolymer, polyvinyl acetate, polyvinylidene chloride, polyacrylate, polycarbonate, cellulose acetate resin, ethyl cellulose resin, polyvinyl butyral, polyvinyl acetal, polyvinyl formal, phenoxy resin, polyvinyl pyridine, poly-N-vinylcarbazole, acrylic resin, silicone resin, nitrile rubber, chloroprene rubber, butadiene rubber, epoxy resin, melamine resin, urethane resin, phenolic resin and alkyd resin. These binder resins may be used alone or in combination.

To prepare the charge generation layer, the above-mentioned binder resin and charge generating material are dispersed or dissolved in an appropriate solvent, and the thus obtained coating liquid is coated on the electroconductive support and dried. An undercoat layer may be interposed between the electroconductive support and the charge generation layer.

Specific examples of the solvent used for the coating liquid for the charge generation layer are benzene, toluene, xylene, methylene chloride, dichloroethane, monochlorobenzene, dichlorobenzene, ethyl alcohol, methyl alcohol, butyl alcohol, isopropyl alcohol, ethyl acetate, butyl acetate, methyl ethyl ketone, cyclohexanone, dioxane, tetrahydrofuran, cyclohexane, methyl cellosolve, and ethyl cellosolve. These solvents may be used alone or in combination.

The proper thickness of the charge generation layer is in the range from about 0.05 to 2 μm, and more preferably in the range from 0.1 to 1 μm.

The charge transport layer of the photoconductor can be prepared in such a manner that a charge transporting material and a binder resin are dissolved or dispersed in a proper solvent and the thus obtained coating liquid for the charge transport layer is coated on the charge generation layer, and then dried. When necessary, a plasticizer, a leveling agent and a wear-resistance improving agent can be added to the coating liquid for the charge transport layer.

Examples of the charge transporting material for use in the charge transport layer are poly-N-carbazole and derivatives thereof, poly-γ-carbazolyl ethylglutamate and derivatives thereof, pyrene-formaldehyde condensation product and derivatives thereof, polyvinylpyrene, polyvinylphenanthrene, oxazole derivatives, imidazole derivatives, triphenylamine derivatives, and other charge transporting materials as disclosed in Japanese Laid-Open Patent Applications 55-154955, 55-156954, 55-52063, 56-81850, 51-10983, 51-94829, 52-128373, 56-29245, 58-58552, 57-73075, 58-198043, 49-105537, 52-139066, and 52-139065.

The same binder resins and solvents as those used in the preparation of the charge generation layer can be employed to obtain the coating liquid for the charge transport layer.

Other features of this invention will become apparent in the course of the following description of exemplary embodiments which are given for illustration of the invention and are not intended to be limiting thereof.

EXAMPLE 1

Formation of Undercoat Layer

A commercially available polyamide resin ("CM-8000" (Trademark), made by Toray Silicone Co., Ltd.) was coated on an aluminum cylinder with a diameter of 80 mm serving as an electroconductive support, so that an undercoat layer with a thickness of about 0.2 μm was formed on the support.

Formation of Charge Generation Layer

A cyclohexanone dispersion of an azo pigment of formula (1) was coated on the above prepared undercoat layer by dip coating, and then dried under application of heat thereto, so that a charge generation layer with a thickness of about 0.1 μm was formed on the undercoat layer.

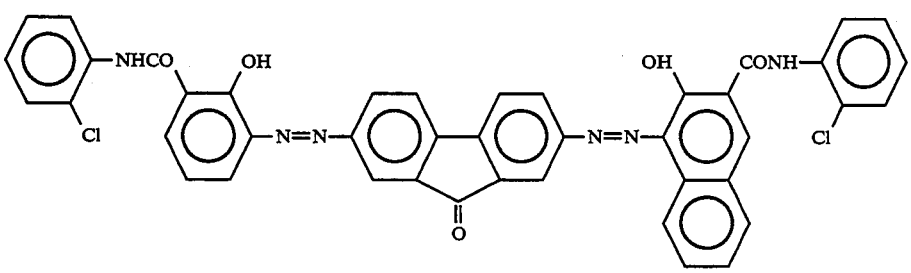

(1)

Formation of Charge Transport Layer

A charge transporting material $D_1$ of formula (2) and a binder resin $R_1$ of formula (3) with a viscosity-average molecular weight of 50,000 were mixed at a ratio by weight ($D_1/R_1$) of 7/10, and the thus obtained mixture was dissolved in methylene chloride so as to obtain a coating liquid with a solid content of 15 wt. %. A commercially available silicone oil ("KF-50" (Trademark), made by Shin-Etsu Silicone Co., Ltd.) was added to the coating liquid for the charge transport layer in an amount ratio thereof to the binder resin $R_1$ of 0.1 wt. %.

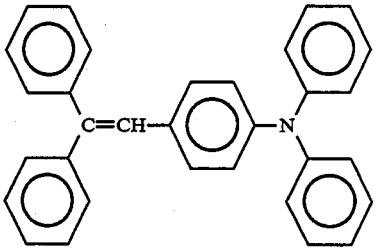

(2)

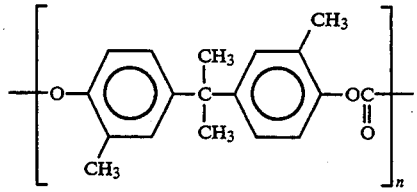

(3)

The thus obtained coating liquid for the charge transport layer was coated on the above prepared charge generation layer by dip coating, and then dried under application of heat thereto, so that a charge transport layer with a thickness of about 25 μm was formed on the charge generation layer. Thus, an electrophotographic photoconductor for use with the image formation method of the present invention was obtained.

The electrophotographic photoconductor thus obtained was set in an electrophotographic copying apparatus using the Carlson process. Furthermore, a rotation-speed-variable exhaust fan was installed in the copying apparatus to control the ozone concentration in the ambient atmosphere around the photoconductor to 10 ppm. The ozone concentration was measured after making of 200 copies at the position just below a charger for charging the photoconductor. The abrasion of the photoconductor was controlled to about 300 Å when the making of 1,000 copies was completed.

Then, the image formation test was carried out by making the copy of 100,000 sheets.

EXAMPLE 2

Using the same electrophotographic photoconductor as prepared in Example 1, the same image formation test as that in Example 1 was carried out by making the copy of 100,000 sheets except that the ozone concentration around the photoconductor was changed from 10 ppm to 5 ppm.

EXAMPLE 3

Using the same electrophotographic photoconductor as prepared in Example 1, the same image formation test as that in Example 1 was carried out by making the copy of 100,000 sheets except that the ozone concentration around the photoconductor was changed from 10 ppm to 20 ppm.

EXAMPLE 4

Using the same electrophotographic photoconductor as prepared in Example 1, the same image formation test as that in Example 1 was carried out by making the copy of 100,000 sheets except that the ozone concentration around the photoconductor was changed from 10 ppm to 50 ppm.

COMPARATIVE EXAMPLE 1

Using the same electrophotographic photoconductor as prepared in Example 1, the same image formation test as that in Example 1 was carried out by making the copy of 100,000 sheets except that the ozone concentration around the photoconductor was changed from 10 ppm to 1 ppm.

COMPARATIVE EXAMPLE 2

Using the same electrophotographic photoconductor as prepared in Example 1, the same image formation test as that in Example 1 was carried out by making the copy of 100,000 sheets except that the ozone concentration around the photoconductor was changed from 10 ppm to 3 ppm.

COMPARATIVE EXAMPLE 3

Using the same electrophotographic photoconductor as prepared in Example 1, the same image formation test as that in Example 1 was carried out by making the copy of 100,000 sheets except that the ozone concentration around the photoconductor was changed from 10 ppm to 70 ppm.

Figure 2:
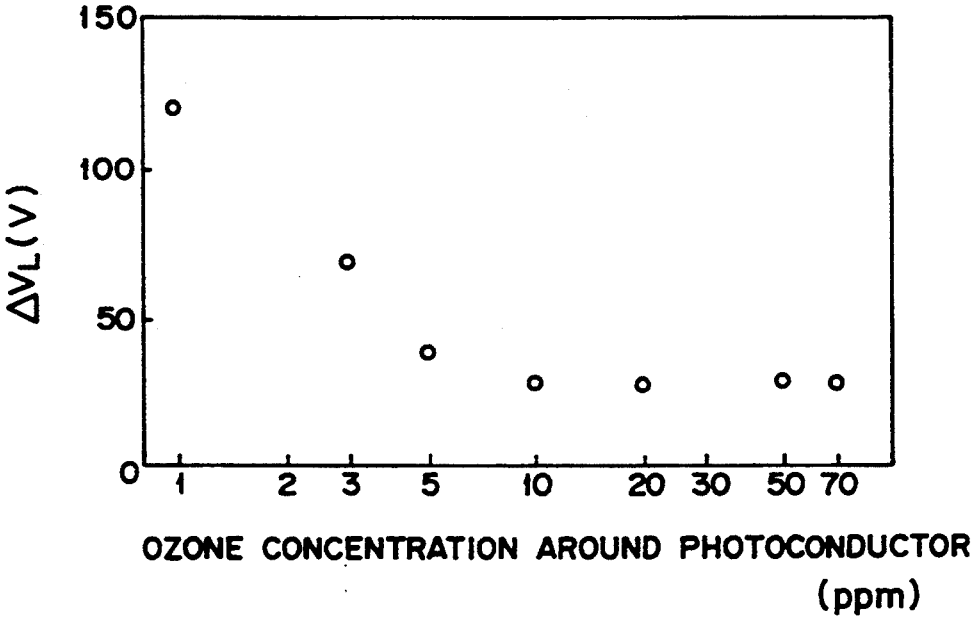
FIG. 2 is a graph which shows the relationship between the changes in the surface potential $\Delta V_L$ (V) of a light portion of a photoconductor and the ozone concentration around the photoconductor.

The changes in the surface potential ($V_L$) of a light portion of the photoconductor corresponding to the concentration of ozone in the ambient atmosphere around the photoconductor, which were obtained in Examples 1 to 4 and Comparative Examples 1 to 3, are shown in FIG. 2.

After making of 100,000 copies, excellent images were produced without any defects by the image formation methods according to the present invention in Examples 1 to 4. In contrast to this, the toner deposition on the background occurred by the comparative image formation methods obtained in Comparative Examples 1 and 2, and the image density decreased in Comparative Example 3.

EXAMPLE 5

Formation of Undercoat Layer

A mixture of the following components was dispersed over a period of 24 hours:

| | Parts by Weight |
|---|---|
| Alkyd resin "Beckolite M-6401" (Trademark), made by Dainippon Ink & Chemicals, Incorporated | 3 |
| Melamine resin "Super Beckamine G-821" (Trademark), made by Dainippon Ink & Chemicals, Incorporated | 2 |
| Titanium oxide ($TiO_2$) "CR-EL" (Trademark), made by Ishihara Sangyo Kaisha, Ltd. | 30 |
| Methyl ethyl ketone | 15 |

The above prepared dispersion was diluted with a mixed solvent of methyl ethyl ketone and isopropyl alcohol at a ratio by weight of 11/9, so that a coating liquid for the undercoat layer was prepared. The thus prepared coating liquid was coated on an aluminum cylinder with a diameter of 80 mm serving as an electroconductive support by dip coating, and then dried under application of heat thereto, so that an undercoat layer with a thickness of about 3 μm was formed on the support.

Formation of Charge Generation Layer

A cyclohexanone dispersion of an azo pigment of formula (4) was coated on the above prepared undercoat layer by dip coating, and then dried under application of heat thereto, so that a charge generation layer with a thickness of about 0.1 μm was formed on the undercoat layer.

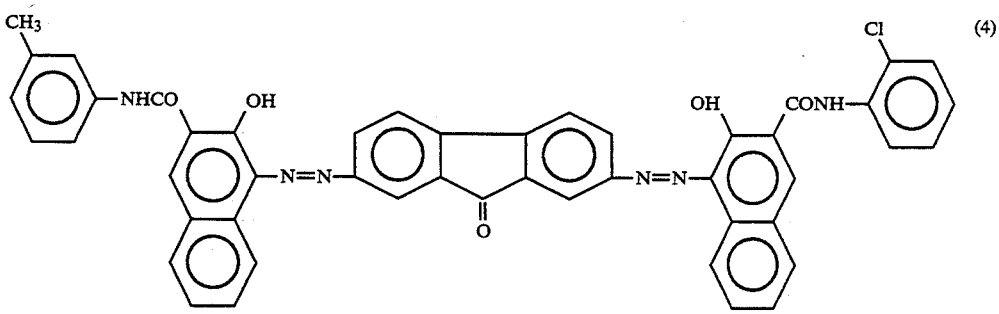

(4)

Formation of Charge Transport Layer

A charge transporting material $D_2$ of formula (5) and a binder resin $R_2$ of formula (6) with a viscosity-average molecular weight of 60,000 were mixed at a ratio by weight ($D_2/R_2$) of 6/10, and the thus obtained mixture was dissolved in methylene chloride so as to obtain a coating liquid with a solid content of 15 wt. %. A commercially available silicone oil ("KF-50" (Trademark), made by Shin-Etsu Silicone Co., Ltd.) was added to the coating liquid for the charge transport layer in an amount ratio thereof to the binder resin $R_2$ of 0.05 wt. %.

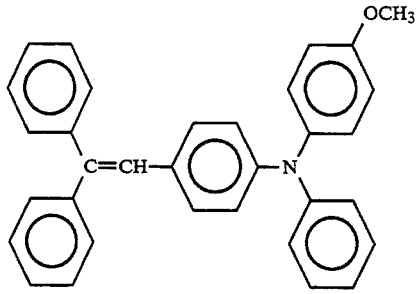

(5)

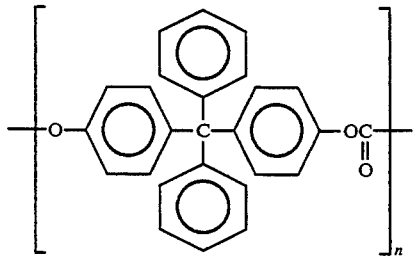

(6)

The thus obtained coating liquid for the charge transport layer was coated on the above prepared charge generation layer by dip coating, and then dried under application of heat thereto, so that a charge transport layer with a thickness of about 30 μm was formed on the charge generation layer. Thus, an electrophotographic photoconductor for use with the image formation method of the present invention was obtained.

The electrophotographic photoconductor thus obtained was set in the same electrophotographic copying apparatus equipped with the rotation-speed-variable exhaust fan as employed in Example 1. The ozone concentration in the ambient atmosphere around the photoconductor was controlled to 5 ppm.

Then, the image formation test was carried out by making the copy of 100,000 sheets.

The decrease in thickness of the photoconductor after making of 1,000 copies and the changes in the surface potential ($V_L$) of a light portion of the photoconductor were measured. The results are shown in Table 1.

EXAMPLE 6

The procedure for preparation of the electrophotographic photoconductor in Example 5 was repeated except that the binder resin $R_2$ of formula (6) with a viscosity-average molecular weight of 60,000 for use in the coating liquid for the charge transport layer in Example 5 was replaced by the binder resin $R_1$ of formula (3) with a viscosity-average molecular weight of 50,000 used in Example 1. Thus, an electrophotographic photoconductor for use with the image formation method of the present invention was obtained.

The electrophotographic photoconductor thus obtained was set in the same electrophotographic copying apparatus as employed in Example 5. The ozone concentration in the ambient atmosphere around the photoconductor was controlled to 5 ppm.

Then, the image formation test was carried out by making the copy of 100,000 sheets in the same manner as in Example 5.

The decrease in thickness of the photoconductor after making of 1,000 copies and the changes in the surface potential ($V_L$) of a light portion of the photoconductor were measured. The results are shown in Table 1.

COMPARATIVE EXAMPLE 4

The procedure for preparation of the electrophotographic photoconductor in Example 5 was repeated except that the binder resin $R_2$ of formula (6) with a viscosity-average molecular weight of 60,000 for use in the coating liquid for the charge transport layer in Example 5 was replaced by a binder resin $R_3$ of formula (7) with a viscosity-average molecular weight of 40,000, and the charge transporting material $D_2$ of formula (5) and the binder resin $R_3$ of formula (7) were mixed at a ratio by weight ($D_2/R_3$) of 9/10.

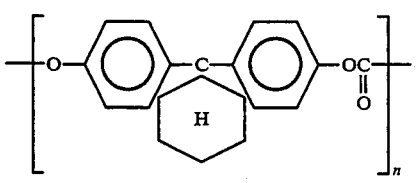

(7)

Thus, an electrophotographic photoconductor was obtained.

The electrophotographic photoconductor thus obtained was set in the same electrophotographic copying apparatus as employed in Example 5. The ozone concentration in the ambient atmosphere around the photoconductor was controlled to 5 ppm.

Then, the image formation test was carried out by making the copy of 100,000 sheets in the same manner as in Example 5.

The decrease in thickness of the photoconductor after making of 1,000 copies and the changes in the surface potential ($V_L$) of a light portion of the photoconductor were measured. The results are shown in Table 1.

COMPARATIVE EXAMPLE 5

The procedure for preparation of the electrophotographic photoconductor in Example 5 was repeated except that the binder resin $R_2$ of formula (6) with a viscosity-average molecular weight of 60,000 for use in the coating liquid for the charge transport layer in Example 5 was replaced by a mixture of the binder resin $R_3$ of formula (7) with a viscosity-average molecular weight of 40,000 and a binder resin $R_4$ of formula (8) with a viscosity-average molecular weight of 40,000 at a mixing ratio by weight of 5/5.

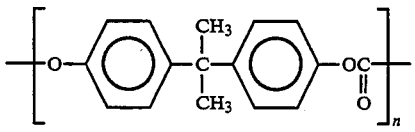

(8)

Thus, an electrophotographic photoconductor was obtained.

The electrophotographic photoconductor thus obtained was set in the same electrophotographic copying apparatus as employed in Example 5. The ozone concentration in the ambient atmosphere around the photoconductor was controlled to 5 ppm.

Then, the image formation test was carried out by making the copy of 100,000 sheets in the same manner as in Example 5.

The decrease in thickness of the photoconductor after making of 1,000 copies and the changes in the surface potential ($V_L$) of a light portion of the photoconductor were measured. The results are shown in Table 1.

COMPARATIVE EXAMPLE 6

The procedure for preparation of the electrophotographic photoconductor in Example 5 was repeated except that the binder resin $R_2$ of formula (6) with a viscosity-average molecular weight of 60,000 for use in the coating liquid for the charge transport layer in Example 5 was replaced by the binder resin $R_4$ of formula (8) with a viscosity-average molecular weight of 40,000.

Thus, an electrophotographic photoconductor was obtained.

The electrophotographic photoconductor thus obtained was set in the same electrophotographic copying apparatus as employed in Example 5. The ozone concentration in the ambient atmosphere around the photoconductor was controlled to 5 ppm.

Then, the image formation test was carried out by making the copy of 100,000 sheets in the same manner as in Example 5.

The decrease in thickness of the photoconductor after making of 1,000 copies and the changes in the surface potential ($V_L$) of a light portion of the photoconductor were measured. The results are shown in Table 1.

TABLE 1

| | Decrease in Thickness of Photoconductor after Making of 1,000 Copies (Å) | $\Delta V_L$ (V) |
|---|---|---|
| Ex. 5 | 230 | 34 |
| Ex. 6 | 300 | 36 |
| Comp. Ex. 4 | 380 | 50 |
| Comp. Ex. 5 | 500 | 74 |
| Comp. Ex. 6 | 690 | 120 |

Figure 3:
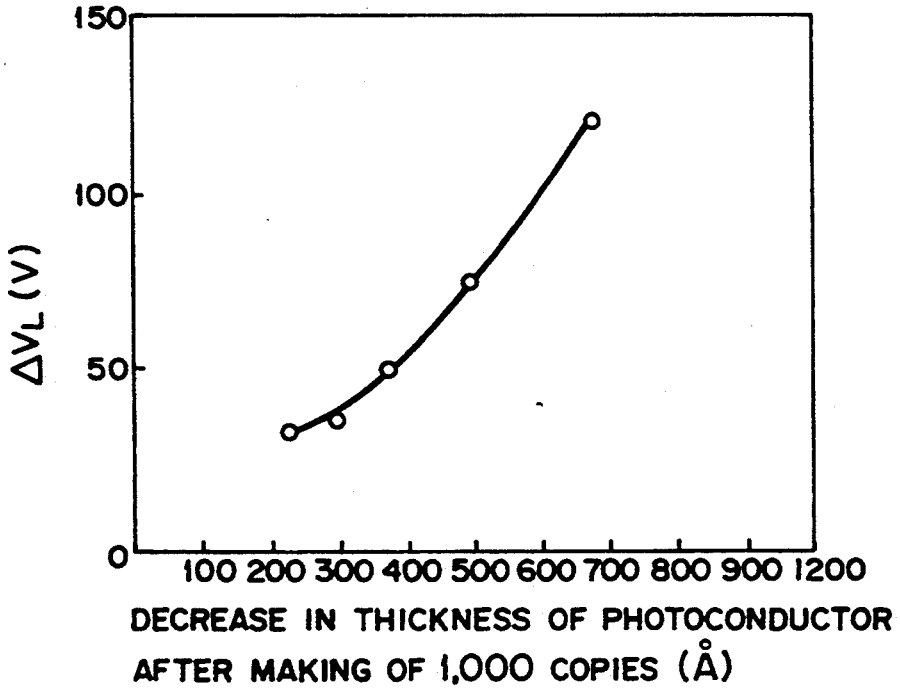
FIG. 3 is a graph which shows the relationship between the changes in the surface potential $\Delta V_L$ (V) of a light portion of a photoconductor and the decrease in thickness of the photoconductor.

Using the results shown in Table 1, the changes in the surface potential ($V_L$) of a light portion of the photoconductor are plotted as ordinate, and the decrease in thickness of the photoconductor after making of 1,000 copies as abscissa, as shown in FIG. 3.

In the image formation test, excellent images were produced without any defects by the electrophotographic image formation methods according to the present invention in Examples 5 and 6. On the other hand, the toner deposition on the background was observed according to the comparative image formation methods in Comparative Examples 4 to 6.

EXAMPLE 7

The same electrophotographic photoconductor as prepared in Example 1 was set in a commercially available electrophotographic copying apparatus in which a cleaning unit was modified so that the pressure contact of a cleaning blade to the photoconductor was 30 g/cm. The ozone concentration in the ambient atmosphere around the photoconductor was controlled to 10 ppm.

Then, the image formation test was carried out by making the copy of 100,000 sheets in the same manner as in Example 1.

The decrease in thickness of the photoconductor after making of 1,000 copies and the changes in the surface potential ($V_L$) of a light portion of the photoconductor were measured. The results are shown in Table 2.

COMPARATIVE EXAMPLE 6

The same electrophotographic photoconductor as prepared in Example 1 was set in a commercially available electrophotographic copying apparatus in which a cleaning unit was modified so that the pressure contact of a cleaning blade to the photoconductor was 60 g/cm. The ozone concentration in the ambient atmosphere around the photoconductor was controlled to 10 ppm.

Then, the image formation test was carried out by making the copy of 100,000 sheets in the same manner as in Example 1.

The decrease in thickness of the photoconductor after making of 1,000 copies and the changes in the surface potential ($V_L$) of a light portion of the photoconductor were measured. The results are shown in Table 2.

TABLE 2

| | Decrease in Thickness of Photoconductor after Making of 1,000 Copies (Å) | $\Delta V_L$ (V) |
|---|---|---|
| Ex. 7 | 290 | 30 |
| Comp. Ex. 6 | 520 | 65 |

In the image formation test, excellent images were produced without any abnormal image by the electrophotographic image formation method according to the present invention in Example 7. On the other hand, the toner deposition on the background was observed by the comparative image formation method in Comparative Example 6.

As previously explained, since the ozone concentration in the ambient atmosphere around the photoconductor was controlled within the range from 5 to 50 ppm, and the abrasion in thickness of the photoconductor was controlled to 300 Å of less per 1,000 revolutions of the photoconductor in the electrophotographic image formation method of the present invention, the decrease in photosensitivity which may be caused by the wear of the surface of the photoconductor can be reduced without any problem such as deterioration in the chargeability of the photoconductor. As a result, excellent images can be produced without any defects such as the toner deposition on the background during the repeated copying operations.

What is claimed is:

1. An electrophotographic image formation method using an electrophotographic photoconductor comprising an electroconductive support, and a photoconductive layer comprising a charge generation layer and a charge transport layer which are successively overlaid on said support, comprising the steps of:

charging the surface of said electrophotographic photoconductor uniformly to a predetermined polarity, exposing said charged surface of said photoconductor to light images to form electrostatic latent images thereon, developing said electrostatic latent images to visible toner images by a developer, transferring said visible toner images to an image-receiving medium, and cleaning the surface of said photoconductor, with the concentration of ozone in the ambient atmosphere around said photoconductor being controlled in the range from 5 to 50 ppm, and the abrasion of said photoconductive layer being controlled to 300 Å or less per 1000 revolutions of said photoconductor.

* * * * *